US010395914B2

(12) United States Patent
Green et al.

(10) Patent No.: US 10,395,914 B2
(45) Date of Patent: Aug. 27, 2019

(54) EFFICIENT ION TRAPPING

(71) Applicant: Micromass UK Limited, Wilmslow (GB)

(72) Inventors: Martin Raymond Green, Bowdon (GB); Kevin Giles, Stockport (GB); David J. Langridge, Macclesfield (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/603,593

(22) Filed: May 24, 2017

(65) Prior Publication Data

US 2017/0345637 A1 Nov. 30, 2017

(30) Foreign Application Priority Data

May 25, 2016 (GB) ..... 1609243.9

(51) Int. Cl.
*H01J 49/00* (2006.01)
*H01J 49/42* (2006.01)

(52) U.S. Cl.
CPC ..... *H01J 49/4225* (2013.01); *H01J 49/4265* (2013.01)

(58) Field of Classification Search
CPC .. H01J 49/00; H01J 49/02; H01J 49/06; H01J 49/061; H01J 49/062; H01J 49/063; H01J 49/065; H01J 49/066; H01J 49/067; H01J 49/068; H01J 49/22; H01J 49/24
USPC ..... 250/281, 282, 283, 286, 290
See application file for complete search history.

(56) References Cited

U.S. PATENT DOCUMENTS

| | | | | |
|---|---|---|---|---|
| 6,891,157 | B2 | 5/2005 | Bateman et al. | |
| 8,946,626 | B2 | 2/2015 | Giles et al. | |
| 9,466,472 | B2 | 10/2016 | Bateman et al. | |
| 2003/0001088 | A1 | 1/2003 | Bateman et al. | |
| 2008/0048113 | A1* | 2/2008 | Franzen | H01J 49/4225 250/292 |
| 2011/0114835 | A1 | 5/2011 | Chen et al. | |
| 2013/0037711 | A1 | 2/2013 | Köster | |
| 2014/0048702 | A1 | 2/2014 | Green et al. | |
| 2014/0299761 | A1 | 10/2014 | Giles et al. | |
| 2016/0042935 | A1 | 2/2016 | Giles et al. | |
| 2016/0329200 | A1* | 11/2016 | Wildgoose | H01J 49/062 |
| 2017/0200597 | A1 | 7/2017 | Giles et al. | |

FOREIGN PATENT DOCUMENTS

CN 101305441 A 11/2008

OTHER PUBLICATIONS

Extended European Search Report for EP Application No. 17172937.9 dated Oct. 6, 2017.

Tolmachev et al., "Collisional Activationf of Ions in RF Ion Traps and Ion Guides: The Effective Ion Temperature Treatment", American Society for Mass Spectrometry, pp. 1616-1628, 2004.

* cited by examiner

*Primary Examiner* — Jason L McCormack

(57) ABSTRACT

An ion trapping system is disclosed comprising an ion urging system for urging ions to spread out within an ion trapping region. Alternatively, the ion trapping system may deflect ions such that ions enter the ion trapping region at different locations. Alternatively, an ion deflector may be arranged upstream of, or at the entrance to, the ion trapping region, for deflecting ions such that ions enter the ion trapping region with different speeds so that the ions spread out within the ion trapping region.

10 Claims, 8 Drawing Sheets

EFFICIENT ION TRAPPING

CROSS-REFERENCE TO RELATED APPLICATION

This application claims priority from and the benefit of United Kingdom patent application No. 1609243.9 filed on 25 May 2016, the entire contents of which are incorporated herein by reference.

FIELD OF THE INVENTION

The present invention relates generally to mass spectrometers and in particular to a mass spectrometer having an ion trap that has a relatively high space-charge capacity.

BACKGROUND

It is known to use an RF confined ion trap upstream of an ion mobility separator (IMS) device in order to increase the duty cycle of the instrument. In particular, ions may be accumulated in the ion trap from an upstream ion source and then pulsed into the IMS device. Whilst the ions are separating within the IMS device it is undesirable to permit further ions to enter the IMS device. During this period, ions from the upstream ion source are accumulated in the ion trap, such that they are not lost and so that the duty cycle of the instrument is improved. These ions may subsequently be pulsed into the IMS device. Ions may therefore be accumulated in the ion trap and periodically released into the downstream ion mobility separation region at the start of each IMS separation cycle.

The ion trap may be operated at a relatively high elevated pressure (e.g., 0.2-20 mbar) that is similar to the pressure used in the IMS device. At such elevated pressures the local charge density within the ion trap increases at the position where the beam of ions enters the ion trap. If the local charge density in the ion trap becomes too high then ions may dissociate due to heating from proximity to the radial confining RF fields. This is a particular problem for thermally labile compounds.

Furthermore, when ions are released from the ion trap into the IMS device, the high charge density caused by the above can cause RF heating in the IMS device and/or distortions in IMS peak width and drift time during separation.

It is therefore desired to provide an improved mass or ion mobility spectrometer, an improved ion trapping system, an improved method of mass or ion mobility spectrometry, and an improved method of trapping ions.

SUMMARY

From a first aspect the present invention provides an ion trapping system comprising:

a plurality of electrodes;

one or more voltage supplies connected to the electrodes, wherein the electrodes and the one or more voltage supplies are adapted and configured to provide an ion trapping region in use;

an ion entrance for receiving ions into the ion trapping region along an ion entrance axis, in use;

an ion ejecting system for ejecting ions from the ion trapping region along an ion exit axis in use, wherein the electrodes and voltage supplies are configured such that the maximum dimension over which the ion trapping region extends orthogonal to the entrance axis and/or exit axis is greater than the maximum dimension over which the ion trapping region extends parallel to the entrance axis and/or exit axis; and further comprising one or more of the following:

(i) an ion urging system for urging ions within the ion trapping region orthogonally to the entrance and/or exit axis so that the ions spread out within the ion trapping region, wherein the ion trapping region is adapted and configured to be maintained at a pressure of ≥0.01 mbar; and/or (ii) an ion deflector arranged upstream of the ion trapping region, wherein the ion deflector is configured to deflect at least some of the ions travelling towards the ion trapping region such that ions entering the ion trapping region enter the ion trapping region at different locations; and/or (iii) an ion deflector arranged upstream of, or at the entrance to, the ion trapping region, wherein the ion deflector is configured to deflect at least some of the ions travelling towards or into the ion trapping region such that ions enter the ion trapping region with different speeds orthogonal to the exit axis and/or the entrance axis so that the ions spread out within the ion trapping region in a direction orthogonal to the entrance axis and/or exit axis.

The ion trapping system of the embodiments of the invention disperses the ions away from the entrance and/or exit axis, thereby reducing space-charge effects during filling of the ion trapping region with ions and/or along the ion exit axis.

US 2013/0037711 discloses a Kingdon ion trap in which ions harmonically oscillate along a longitudinal axis as they orbit around a central electrode. The harmonic oscillations induce an electric current on detector electrodes, which may then be Fourier transformed so as to determine the mass to charge ratios of the ions. However, such devices require an ultra-high vacuum in order to operate. In contrast, embodiments of the present invention require that the ion trapping region is maintained at a pressure of ≥0.01 mbar. It is at such relatively high pressures that the ions lose their kinetic energy by interactions with the background gas molecules and difficulties occur in filling the ion trapping region efficiently.

WO 2013/027054 discloses a spatially extended ion trapping region. Referring to FIG. 3A-C, ions may enter the device either along either the z-dimension or along the x-dimension and a quadratic DC potential may be applied along the device in the z-dimension such that the ions are trapped in trapping region 302. The quadratic well may then be modulated in the z-dimension so as to mass selectively eject ions from the ion trapping region. However, WO'054 does not disclose maintaining the ion trapping region at a pressure of ≥0.01 mbar during the modulation of the quadratic well that mass selectively ejects ions. Such high pressures would not be used during the ejection mass selective ejection method described. Higher pressures are mentioned in WO'054, although these are in relation to the use of the ion trapping region in other modes, such as a collision cell.

Option (i) according to the first aspect of the present invention may comprise an ion urging system for urging ions within the ion trapping region orthogonally to the entrance axis so that the ions spread out within the ion trapping region, wherein the maximum dimension over which the ion trapping region extends orthogonal to the entrance axis is greater than the maximum dimension over which the ion trapping region extends parallel to the entrance axis. In WO '054, when the quadratic well urges ions orthogonally to the entrance axis, the maximum dimension over which the ion trapping region extends orthogonal to the entrance axis is not greater than the maximum dimension over which the ion trapping region extends parallel to the entrance axis.

Option (i) according to the first aspect of the present invention may comprise an ion urging system for urging ions within the ion trapping region orthogonally to the exit axis so that the ions spread out within the ion trapping region, wherein the maximum dimension over which the ion trapping region extends orthogonal to the exit axis is greater than the maximum dimension over which the ion trapping region extends parallel to the exit axis. In WO '054 does not disclose or suggest urging ions within the ion trapping region orthogonally to the exit axis so that the ions spread out within the ion trapping region.

The ion trapping system of the present invention may be set up and configured to perform steps (i) and/or (ii) and/or (iii) during filling of the trap with ions.

The ion trapping system may be set up and configured such that the ion urging system substantially does not cause ions to exit the ion trapping region and/or does not mass selectively eject ions from the ion trapping region.

The ion trapping system may be set up and configured such that the ion trapping region is static with time.

The ion trapping region of the embodiments of the present invention has a greater ion trapping capacity orthogonal to the exit axis than parallel to the exit axis. As such, the ion trapping region is able to have a relatively high charge capacity whilst minimising the spatial spread of the ions parallel to the ion exit axis, and hence minimising the spatial spread of the ions in the direction of ejection into a downstream device, such as a mass and/or ion mobility analyser. The ions may therefore be ejected from the ion trapping region into the downstream device as an ion packet having a relatively small dimension parallel to the exit axis. This may be useful, for example, if the downstream device is configured to only receive ions during a time window, or if all ions from the ion trapping region are desired to enter the downstream device at substantially the same time (e.g., if the downstream device is a drift time ion mobility separator).

The maximum dimension over which the ion trapping region extends parallel to the entrance and/or exit axis may be x % of the maximum dimension over which the ion trapping region extends orthogonal to the entrance and/or exit axis, wherein x is selected from the group consisting of: ≤10; ≤15; ≤20; ≤25; ≤30; ≤35; ≤40; ≤45; ≤50; ≤55; ≤60; ≤65; ≤70; ≤75; ≤80; ≤85; and ≤90.

The electrodes and voltage supplies may be configured such that the maximum ion trapping area over which the ion trapping region extends in a plane orthogonal to the entrance axis and/or exit axis is greater than the maximum ion trapping area over which the ion trapping region extends in a plane parallel to the entrance axis and/or exit axis. The maximum ion trapping area over which the ion trapping region extends in a plane parallel to the entrance and/or exit axis may be y % of the maximum ion trapping area over which the ion trapping region extends in a plane orthogonal to the entrance and/or exit axis, wherein y is selected from the group consisting of: ≤10; ≤15; ≤20; ≤25; ≤30; ≤35; ≤40; ≤45; ≤50; ≤55; ≤60; ≤65; ≤70; ≤75; ≤80; ≤85; and ≤90. The ion trapping region may therefore have a significantly greater ion trapping capacity orthogonal to the entrance and/or exit axis than parallel to the entrance and/or exit axis.

The system may comprise a controller and electronic circuitry arranged and configured to: control the one or more voltage supplies so as to apply voltages to the electrodes such that ions are able to be received into the ion trapping region along said entrance axis and trapped in the ion trapping region during an ion filling period; and the controller may be arranged and configured to: (i) control the ion urging system to urge ions to spread out within the ion trapping region orthogonally to the entrance and/or exit axis during the ion filling period; and/or (ii) control the ion deflector to deflect at least some of the ions travelling towards the ion trapping region such that ions entering the ion trapping region enter the ion trapping region at different locations during the ion filling period; and/or (iii) control the ion deflector to deflect at least some of the ions travelling towards or into the ion trapping region such that ions enter the ion trapping region with different speeds orthogonal to the exit axis and/or the entrance axis during the ion filling period so that the ions spread out within the ion trapping region in a direction orthogonal to the entrance axis and/or exit axis.

The ion urging system may be arranged and configured to urge the ions to spread out within the ion trapping region in a dimension corresponding to the maximum dimension of the ion trapping region.

The ion urging system may be configured to urge the ions in different directions, e.g. opposite directions, so that they spread out within the ion trapping region.

The ion urging system may be configured to urge the ions away from a central axis within the ion trap.

The ion urging system may be adapted and configured to apply a potential gradient, optionally a DC potential gradient, across the ion trapping region for causing said ions to spread out orthogonally to the entrance axis and/or exit axis; and/or the ion urging system may be adapted and configured to translate at least one transient DC voltage along the ion trapping region for causing said ions to spread out orthogonally to the entrance axis and/or exit axis; and/or the ion urging system may comprise a gas pump adapted and configured to create a gas flow for causing said ions to spread out orthogonally to the entrance axis and/or exit axis.

The system may comprise a plurality of electrodes spaced along the ion trapping region and the ion urging system may be configured to successively apply a transient DC voltage to successive different ones of the electrodes along the ion trapping region at different times so as to translate the transient DC voltage along the ion trapping region.

The transient DC voltage may be repeatedly travelled along the ion trapping region so as to cause the ions to spread out orthogonally to the entrance axis and/or exit axis.

A plurality of transient DC voltages may be travelled along the ion trapping region in a plurality of directions for causing the ions to spread out orthogonally to the entrance axis and/or exit axis. Different transient DC voltages may be travelled along the ion trapping region in different directions from the entrance axis and/or exit axis. For example, transient DC voltages may be travelled along the ion trapping region in opposite directions and in directions away from the entrance axis and/or exit axis.

The amplitude of the transient DC voltage(s) may progressively reduce as it is translated along the ion trapping region. For example, the amplitude may be reduced as the transient DC voltage travels towards a side of the ion trapping region. This may prevent excessive numbers of ions being urged against the edge of the ion trapping region and so may prevent an increase in space charge effects at this location.

Extending the ion trapping volume in a single dimension is particularly useful where a transient DC voltage is used to drive ions in the ion trapping region. For example, when a transient DC voltage is applied along a device so as to manipulate the ions, it is desirable to position the electrodes to which these voltages are applied close to the ions, thus limiting the size of the device in one dimension. In order to compensate for this, the size of the device may be made relatively large in another dimension.

The ion trapping region may comprise a first array of electrodes, a second array of electrodes spaced apart from the first array of electrodes, and one or more voltage supplies connected to said arrays of electrodes for applying one or more voltages to the electrodes so as to confine ions in the direction between the arrays of electrodes. The at least one of said arrays may comprise a plurality of electrodes spaced along a first dimension of the array that is orthogonal to the direction between the arrays. The ion urging system may be configured to apply different voltages the electrodes along the first dimension of the array so as to generate said potential gradient along the first dimension. Additionally, or alternatively, the ion urging system may be configured to successively apply a transient DC voltage to successive different ones of the electrodes along the first dimension of the array at different times so as to translate the transient DC voltage along the first dimension of the ion trapping region.

The ion urging system may accelerate the rate at which ions are distributed within the ion trapping region, and hence reduce local space-charge densities, particularly as the ion trapping region is being filled with ions. The ion trapping region may have a central axis parallel to, and optionally coaxial with, the entrance and/or exit axis. The ion urging system may be configured to drive ions away from this central axis so as to spread the ions across the ion trapping region. For example, the ions may be urged in two opposite directions away from the central axis.

The ion urging system may urge ions away from the location at which ions enter the ion trapping region. This location may have the highest charge density and space-charge effects within the ion trapping region, and so it may be useful for the ion urging system to drive ions away from this region as the ion trapping region is being filled with ions.

The ion deflector may be configured to deflect ions travelling towards the ion trapping region such that ions entering the ion trapping region either (i) at the same time, or (ii) at different times, enter the ion trapping region at different locations; optionally wherein the ion deflector is configured to deflect ions by varying the mean axis along which ions enter the ion trapping region with time, or by defocussing, diverging, splitting or otherwise spreading out at least some of the ions in an ion beam or ion packet.

For example, one or more electrodes may be arranged in the path of the ion beam or ion packets that spit or spread the ion beam travelling towards or into the ion trapping region. For example, a conical or other shaped electrode having an apex may be arranged in the path of the ion beam or ion packets such that the ions are split or spread by the apex of the electrode.

Ions entering the ion trapping region at different times may be given different speeds orthogonal to the entrance axis and/or the exit axis.

The ion deflector may comprise at least one electrode and at least one voltage supply adapted and configured to apply a time varying electrical potential to the at least one electrode for performing the step of deflecting the ions.

The time varying potential may be a DC potential.

The time varying potential may vary in magnitude with time.

The at least one electrode of the ion deflector may comprise at least one pair of electrodes arranged on opposite sides of an ion beam axis. The time varying potential applied to these electrodes may be varied in time such that the magnitude and/or direction of the potential difference between the electrodes varies with time.

The at least one electrode may comprises a plurality of pairs of electrodes, each pair having electrodes arranged on opposite sides of the ion beam axis. The time varying potentials applied to these electrodes may be varied in time such that the magnitude and/or direction of the potential difference between each pair of electrodes varies with time.

At least three electrodes may be arranged circumferentially at different locations around the ion beam axis, and the at least one voltage supply may be configured to vary the voltages applied to the at least three electrodes with time such that ions are deflected with a velocity component orthogonal to the ion beam axis, wherein the direction of the orthogonal velocity component varies with time. Optionally, the direction of the orthogonal velocity component rotates around the ion beam axis with time.

The ion deflector may comprise an inverted ion funnel arranged upstream of the ion trapping region, the inverted ion funnel comprising at least one inner electrode and at least one outer electrode surrounding the at least one inner electrode and defining an ion guiding path therebetween, wherein the ion guiding path has a cross-sectional area that increases in a direction towards the ion trapping region.

The inverted ion funnel may comprise one or more voltage supplies for applying voltages to the at least one inner electrode and to the at least one outer electrode in order to radially confine ions in the space therebetween. The voltages may be RF voltages.

The at least one inner electrode may be an array of coaxially arranged circular or ring electrodes. The outer diameter of these electrodes may increase in a direction towards the ion trapping region. Alternating phases of an RF voltage may be applied to adjacent electrodes in this array. The at least one outer electrode may be an array of coaxially arranged circular or ring electrodes. The inner diameter of these electrodes may increase in a direction towards the ion trapping region. Alternating phases of an RF voltage may be applied to adjacent electrodes in this array.

The ion deflector may be configured to cause ions to spiral around the at least one inner electrode as they travel towards the ion trapping region; or the ion deflector may be configured to cause ions to travel in an axial direction along the ion funnel, substantially without spiralling around the at least one inner electrode, and such that the ions entering the inverted ion funnel at different times travel along different axial ion paths.

The inverted ion funnel may be provided between the ion deflector portion that deflects ions orthogonal to the ion beam axis, and the ion trapping region.

The ion deflector may comprise at least one electrode arranged radially spaced from an ion beam axis and at least one voltage supply configured to apply at least one voltage to this at least one electrode so as to simultaneously urge ions in multiple directions orthogonal to the ion beam axis; optionally wherein the at least one electrode at least partially surrounds the ion beam axis.

The at least one electrode may comprise a plurality of electrodes arranged at different radial distances from the ion beam axis, wherein the at least one voltage supply is configured to apply DC potentials to these electrodes so as to generate a static DC potential gradient in the radially outward direction or a travelling DC potential barrier that travels in the radially outward direction for simultaneously urging ions in multiple directions orthogonal to the ion beam axis.

The ion deflector may comprise an ion blocking electrode arranged downstream of said at least one electrode on the ion beam axis and a voltage supply for applying a voltage to the ion blocking electrode to repel ions away from it, optionally such that the ion blocking electrode and the at least one electrode cooperate to simultaneously urge ions in multiple directions orthogonal to the ion beam axis.

The at least one electrode (and the optional ion blocking electrode) may be provided between the ion deflector portion that deflects ions orthogonal to the ion beam axis, and the ion trapping region.

The ion trapping system comprises a plurality of electrodes and one or more voltage supplies connected to said electrodes for applying one or more voltages to the electrodes so as to confine ions within the ion trapping region. The one or more voltages may include an RF voltage.

The ion trapping region and voltage supplies may be configured to trap ions in three dimensions (e.g., optionally during or after ion filling). The ion trapping system may be, or may comprise, a 3D ion trap for trapping the ions.

The ion tapping region and voltage supplies may be configured to trap ions such that ions substantially do not dissociate in the ion trapping region.

The ion trapping region may comprise a first array of electrodes, a second array of electrodes spaced apart from the first array of electrodes, and one or more voltage supplies connected to said arrays of electrodes for applying one or more voltages to the electrodes so as to confine ions in the space between the arrays of electrodes. The one or more voltage supplies may comprise an RF voltage supply for applying an RF potential to the electrodes so as to confine ions in between the arrays of electrodes. Adjacent electrodes in each array may be connected to different, optionally opposite, phases on the RF voltage supply.

The ion trapping region may comprise at least one voltage supply arranged and configured for confining ions in the dimensions orthogonal to the direction between the arrays of electrodes. This may be achieved by providing electrodes at the edges of the (e.g., planar) arrays and applying potentials, optionally DC potentials, to these electrodes so as to prevent ions leaving the ion trapping volume between the arrays until desired.

Alternatively, at least one of the arrays may comprise a plurality of electrodes spaced along a first dimension of the array that is orthogonal to the direction between the arrays, and the at least one voltage supply may be configured to apply different potentials, optionally different DC potentials, to these electrodes for creating a potential well or potential barriers that confine ions in the space between the arrays and in a direction in the first dimension. Alternatively, or additionally, at least one of the arrays may comprise a plurality of electrodes spaced along a second different dimension of the array that is orthogonal to the direction between the arrays and orthogonal to the first dimension, wherein the at least one voltage supply may be configured to apply different potentials, optionally different DC potentials, to these electrodes for creating a potential well or potential barriers that confine ions in the space between the arrays and in a direction in the second dimension. These electrodes may create a quadratic DC potential in said direction in the first dimension and/or in said direction in the second dimension.

Said first and second arrays may be substantially planar arrays. The planes of the arrays may be parallel to the exit axis and/or entrance axis.

The first and second arrays may be curved so as to provide an arcuate ion trapping region therebetween; and/or the first and second arrays may be curved or have another non-linear configuration so as to provide an ion trapping region therebetween in the form of a hollow cylinder or other shaped hollow tube.

The radius of curvature of the arcuate trapping region or hollow tube may be orthogonal to the ion entrance axis and/or ion exit axis.

The first and/or second ion urging means may drive ions circumferentially around the arcuate hollow tube.

The ion trapping region may be adapted and configured to be maintained at a pressure selected from the group consisting of: $\geq 1\times10^{-2}$ mbar; $\geq 5\times10^{-2}$ mbar; ≥0.1 mbar; ≥0.5 mbar; ≥1 mbar; ≥5 mbar; ≥10 mbar; ≥15 mbar; ≥20 mbar; ≥30 mbar; ≥40 mbar; ≥50 mbar; ≥100 mbar; ≥250 mbar; and ≥50 mbar.

The first aspect of the invention also provides a mass and/or ion mobility spectrometer comprising an ion trapping system as described herein and an ion receiving device arranged downstream of the ion trapping system for receiving ions from the exit of the ion trapping system.

The spectrometer may comprise a controller, a voltage supply and circuitry arranged and configured to pulse ions out of the ion trapping region and into the ion receiving device.

The ion trapping region of the embodiments has a greater ion trapping capacity orthogonal to the exit axis than parallel to the exit axis. As such, the ion trapping region is able to have a relatively high charge capacity whilst minimising the spatial spread of the ions parallel to the ion exit axis, and hence minimising the spatial spread of the ions in the direction of ejection into the ion receiving device. The ions may therefore be ejected from the ion trapping region into the ion receiving device as a relatively small packet in the dimension parallel to the exit axis.

The ion receiving device may be an ion separation device arranged for receiving ions from the exit of the ion trapping region and separating these ions according to a physicochemical property; and/or the ion receiving device may be adapted and configured to receive ions through an entrance gate that is opened and closed over time, optionally wherein the opening of the gate is synchronised with one or more periods over which ions are ejected from the ion trapping region.

The ion separation device may be configured to separate the ions according to said physicochemical property along an ion separation axis that is parallel and/or coaxial with said exit axis of the ion trapping region; optionally wherein the separation device is an ion mobility separator and the physicochemical property is ion mobility.

As described above, the ion trapping region of the embodiments minimises the spatial spread of the ions parallel to the ion exit axis, and hence minimises the spatial spread of the ions in the direction of ejection into the ion separation device. The ions may therefore be ejected from the ion trapping region into the ion separation device as a relatively small packet in the dimension parallel to the exit axis, and hence the resolution of the ion separation device is relatively high.

The ion mobility separator may be configured to drive the ions through a gas so as to cause the ions to separate according to ion mobility along an (or said) ion separation axis. The spectrometer may drive the ions through the gas by pulsing the ions into, or within, the ion mobility separator so that they travel through the gas along the separation axis. Alternatively, or additionally, a DC voltage gradient may be arranged along the ion separation device for driving ions though the gas. Alternatively, or additionally, to the above option, a DC voltage may be travelled along the ion separation device for driving ions though the gas.

The spectrometer may be configured to pulse ions out of the ion trapping region into the ion separation device.

As described above, the physicochemical property by which the separation device separates the ions may be ion mobility, e.g., drift time ion mobility through a gas-filled drift time ion mobility separator. However, other physicochemical properties are also contemplated, such as mass to charge ratio.

Alternatively, it is also contemplated that the ion receiving device may be an ion trap, ion guide, ion detector, mass analyser or other form of ion mobility analyser.

The ion trapping region and ion receiving device may be configured to be maintained at a pressure selected from the group consisting of: $\geq 1\times10^{-2}$ mbar; $\geq 5\times10^{-2}$ mbar; ≥0.1 mbar; ≥0.5 mbar; ≥1 mbar; ≥5 mbar; ≥10 mbar; ≥15 mbar; ≥20 mbar; ≥30 mbar; ≥40 mbar; ≥50 mbar; ≥100 mbar; ≥250 mbar; and ≥50 mbar.

The spectrometer may comprise an ion source for providing ions to said ion trapping region, wherein said ions may be thermally labile ions.

The ions may have different ion mobilities (e.g. different mobilities through a gas in a drift tube.

It is contemplated that the ion trapping region may not necessarily be adapted and configured to be maintained at a pressure of ≥0.01 mbar.

Accordingly, the first aspect of the present invention also provides an ion trapping system comprising:

a plurality of electrodes;

one or more voltage supplies connected to the electrodes, wherein the electrodes and the one or more voltage supplies are adapted and configured to provide an ion trapping region in use;

an ion entrance for receiving ions into the ion trapping region along an ion entrance axis, in use;

an ion ejecting system for ejecting ions from the ion trapping region along an ion exit axis in use, wherein the electrodes and voltage supplies are configured such that the maximum dimension over which the ion trapping region extends orthogonal to the entrance axis and/or exit axis is greater than the maximum dimension over which the ion trapping region extends parallel to the entrance axis and/or exit axis; and further comprising one or more of the following:

(i) an ion urging system for urging ions within the ion trapping region orthogonally to the entrance and/or exit axis so that the ions spread out within the ion trapping region; and/or (ii) an ion deflector arranged upstream of the ion trapping region, wherein the ion deflector is configured to deflect at least some of the ions travelling towards the ion trapping region such that ions entering the ion trapping region enter the ion trapping region at different locations; and/or (iii) an ion deflector arranged upstream of, or at the entrance to, the ion trapping region, wherein the ion deflector is configured to deflect at least some of the ions travelling towards or into the ion trapping region such that ions enter the ion trapping region with different speeds orthogonal to the exit axis and/or the entrance axis so that the ions spread out within the ion trapping region in a direction orthogonal to the entrance axis and/or exit axis.

From a second aspect the present invention provides an ion trapping system comprising:

a plurality of electrodes;

one or more voltage supplies connected to the electrodes, wherein the electrodes and the one or more voltage supplies are adapted and configured to provide an ion trapping region in use;

an ion entrance for receiving ions into one end of the ion trapping region and an ion exit for ejecting ions from another end of the ion trapping region, in use;

an ion urging system adapted and configured to translate at least one transient DC voltage along the ion trapping region from the ion entrance to the ion exit for urging along the ion trapping region, wherein the ion urging device is adapted and configured to control the transient DC voltage so that the force it applies to the ions towards the exit decreases as the transient DC voltage travels towards the exit; and a control system adapted and configured to control the one or more voltage supplies to apply one or more voltages to the electrodes to prevent ions being ejected from the ion trapping region by the at least one transient DC voltage when the transient DC voltage reaches the ion exit.

The transient DC voltage in this ion trapping system disperses ions within the ion trapping region during filling of the ion trapping region and prior to ejection of any ions from the ion exit. This alleviates space charge effects near the ion entrance during filling of the ion trapping region. As the force the transient DC voltage applies to the ions decreases as the transient DC voltage travels towards the exit, the transient DC voltage does not cause excessive space charge effects in the region of the exit of the ion trapping region.

Ion guides are known in which a transient DC voltage is used to travel ions along the ion guide. However, in contrast to the second aspect of the invention, the transient DC voltage ejects ions from the device at the exit of the device.

The ion urging device of the second aspect of the invention may be configured to urge ions from one end of the ion trapping region towards another end of the ion trapping region, wherein the ion urging device is configured to urge ions along at least z % of the length between the ends of the ion trapping region, wherein z is selected from the group consisting of: 75; 80; 85; 90 and 95.

The amplitude of the transient DC voltage may decrease, progressively decrease or decay as is travels from the ion entrance to the ion exit.

Alternatively, the speed of the transient DC voltage along the ion trapping region may be controlled so that the force it applies to the ions towards the exit decreases as the transient DC voltage travels towards the exit.

The ion trapping region may be elongated, optionally having the ion entrance at one end of the ion trapping region and an ion exit at an opposite end of the ion trapping region, through which ions exit in use.

The maximum dimension over which the ion trapping region extends parallel to the entrance axis may be greater than the maximum dimension over which the ion trapping region extends orthogonal to the entrance axis; and/or the maximum ion trapping area over which the ion trapping region extends in a plane parallel to the entrance axis may be greater than the maximum ion trapping area over which the ion trapping region extends in a plane orthogonal to the entrance axis.

The ion trapping system may be configured substantially not to fragment or react ions in the ion trapping region.

The controller may be arranged and configured to: control the one or more voltage supplies so as to apply voltages to the electrodes such that ions are able to be received into the ion trapping region through the ion entrance and trapped in the ion trapping region during an ion filling period; and to control the ion urging system so that the transient DC voltage transient DC voltage travels along the ion trapping region during the ion filling period.

The ion trapping system according to the second aspect of the invention may comprise any of the optional features described in relation to the first aspect of the invention.

For example, the ion trapping system described herein may have an ion trapping region having a first array of electrodes, a second array of electrodes spaced apart from the first array of electrodes, and one or more voltage supplies connected to said arrays of electrodes for applying one or more voltages to the electrodes so as to confine ions in the space between the arrays of electrodes.

The second aspect of the invention also provides a mass spectrometer or ion mobility spectrometer comprising: an ion trapping system as described above; and an ion receiving device arranged downstream of the ion trapping system for receiving ions from the exit of the ion trapping system.

The ion trapping system and/or ion receiving device according to the second aspect of the invention may comprise any of the optional features described in relation to the ion trapping system and/or ion receiving device of the first aspect of the invention.

The first aspect of the invention also provides a method of trapping ions comprising:

providing an ion trapping system as described above;

applying voltages to the plurality of electrodes so as to provide the ion trapping region;

receiving ions into the ion trapping region along the ion entrance axis and preventing ions exiting the ion trapping region, whilst performing one or more of the following:

(i) using the ion urging system to urge ions within the ion trapping region orthogonally to the entrance and/or exit axis so that the ions spread out within the ion trapping region; and/or (ii) using the ion deflector to deflect ions travelling towards the ion trapping region such that ions entering the ion trapping region enter the ion trapping region at different locations; and/or (iii) using the ion deflector to deflect ions travelling towards or into the ion trapping region such that ions enter the ion trapping region with different speeds orthogonal to the exit axis and/or the entrance axis so that the ions spread out within the ion trapping region in a direction orthogonal to the entrance axis and/or exit axis.

The method may comprise operating the ion trapping system to perform any of the features described in relation to the system of the first aspect of the invention.

The first and second aspects of the invention also provide methods of mass or ion mobility spectrometry comprising a method of trapping ions as described herein and ejecting ions from the ion trapping region into an ion receiving device as described herein.

In embodiments of the invention described herein, a driving force may be applied during the ion trap filling period to distribute ions more evenly during trapping. This may mitigate local charge build up, which can otherwise lead to ion losses and/or distortion in the ion analysis, e.g. in an ion mobility drift time and peak shape.

The ion beam may be introduced in an orthogonal direction (or in the special case of an annular trapping region, in an orthogonal or tangential direction) with respect to the direction in which the ion trapping region is extended. This allows the driving forces described herein to distribute ions correctly throughout the trapping volume.

The ions may be released from the ion trapping region into an IMS device.

The ion beam may enter the ion trapping region orthogonal to the direction in which the trapping region is extended and/or the ion trapping region may be extended in a direction orthogonal to the mobility separation direction.

The spectrometer described herein may comprise an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI").

The spectrometer may comprise one or more continuous or pulsed ion sources.

The spectrometer may comprise one or more ion guides.

The spectrometer may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions;

(xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The spectrometer may comprise a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

A chromatography detector may be provided, wherein the chromatography detector comprises either: a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which.

DETAILED DESCRIPTION

Figure 1:
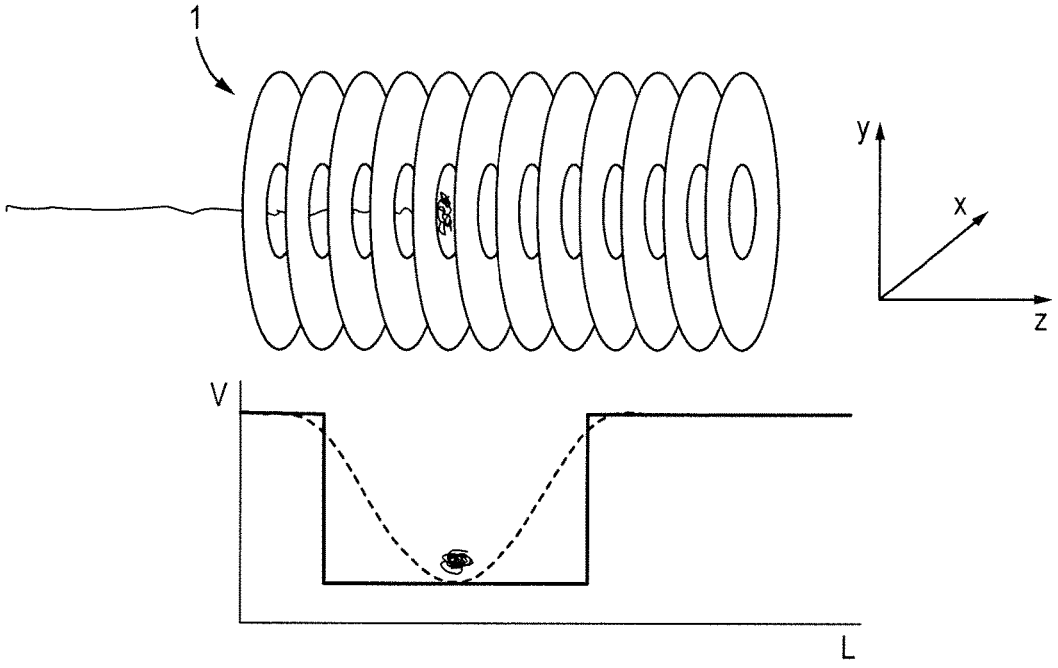
FIG. 1 shows a schematic of a prior art stacked ring ion guide having an ion trapping region.

FIG. 1 shows a schematic of a prior art stacked ring ion guide 1 having an ion trapping region. The ion guide is formed from a plurality of apertured electrodes having their apertures aligned so as to form an ion guiding channel through the ion guide. Opposite phases of a radio frequency AC voltage are applied to adjacent ring electrodes so as to form an RF pseudo-potential well that radially confines ions within the ion guide. An axial DC potential well is formed in the ion guide by application of appropriate DC potentials to the electrodes in the ion guide. The solid line in the lower plot of FIG. 1 shows the DC voltages applied to the electrodes as a function of the distance L along the ion guide. It can be seen that the same DC voltages are applied to the electrodes at the ends of the ion guide, but that a lower DC voltage is applied to a subset of the electrodes between the ends of the ion guide. The dotted line in the lower plot of FIG. 1 shows the DC potential profile arranged along the ion guide as a result of the DC voltages applied to the electrodes. As can be seen, a DC well is generated that confines ions to a narrow trapping region of the ion guide.

The ion guide may be coupled to an ion mobility separation (IMS) device in order to improve the duty cycle of the instrument. For example, ions may be accumulated in the trapping region of the ion guide from an upstream source of ions and then pulsed into the IMS device. Whilst the ions are separating in the IMS device it may be undesirable to permit further ions to enter the IMS device. During this period, ions from the upstream ion source are accumulated in the trapping region of the ion guide, such that they are not lost and so that the duty cycle of the instrument is improved. These ions may subsequently be pulsed into the IMS device. Ions may therefore be accumulated in the trapping region and periodically released into the downstream ion mobility separation region at the start of each IMS separation cycle.

However, the ion trapping region shown in FIG. 1 has a relatively low ion trapping volume and hence has a relatively low space-charge capacity. In order to provide a relatively large ion trapping volume, so as to minimize local charge density, the dimensions of the ion trapping region may be extended in one or more dimensions. However, if the ion trapping volume is extended in the same direction as the direction of ion mobility separation in the IMS device, then the ions must be refocused in the direction of ion mobility separation prior to the ion mobility separation in order to maintain a high resolution for ion mobility measurements. On the other hand, if the ion trapping region is extended in a direction orthogonal to the direction of ion separation in the IMS device, then the ion cloud trapped in the ion trapping region would have minimal spatial spread in the direction of ion mobility separation. This would allow rapid and efficient transfer of ions from the ion trapping region into the ion separation region, because it minimizes or negates the requirement to refocus the ions in the direction of ion mobility separation prior to pulsing the ions into the IMS device.

Figure 2:
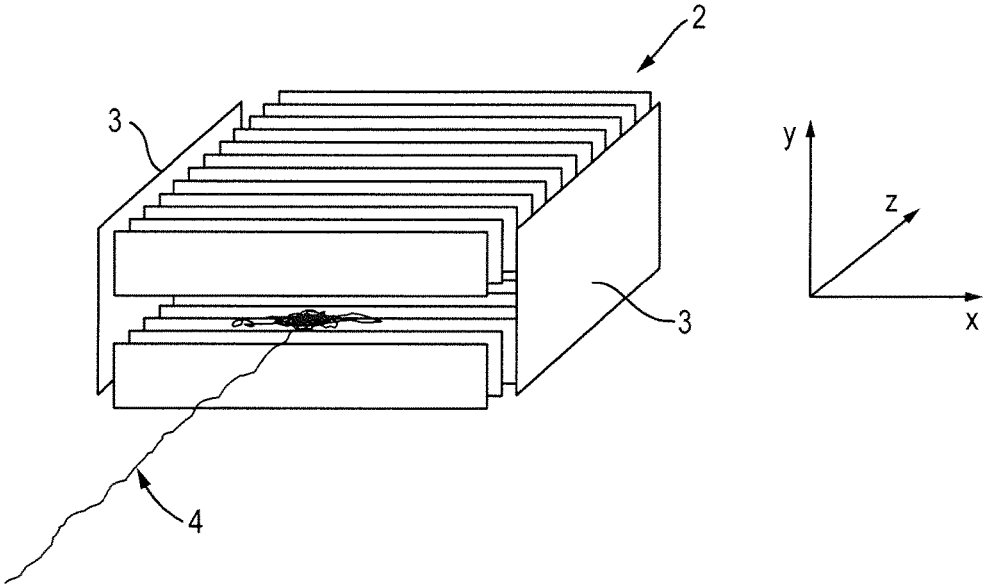
FIG. 2 shows an example of the geometry of an ion trap that may be used in accordance with the present invention.

FIG. 2 shows an example of the geometry of an ion trap that has been extended in an attempt to reduce space-charge effects. The ion trap comprises an upper array of parallel plate electrodes 2 that is spaced apart from a corresponding lower array of parallel plate electrodes so as to form an ion guiding region between the arrays. The plate electrodes are arranged such that their planes extend in the direction from the upper array to the lower array. A side plate electrode 3 is arranged at each side of the ion trap so as to extend between the upper and lower arrays. Each side plate electrode 3 has its plane orthogonal to the planes of the plate electrodes 2 in the upper and lower arrays. Ions are able to be confined between the upper and lower arrays of electrodes in the y-dimension by applying opposite phases of an RF voltage to electrodes plates 2 that are adjacent to each other in the z-dimension. Ions are able to be confined in the x-dimension by applying DC voltages to the side plates electrodes 3. Ions may be trapped in the z-dimension by applying different DC voltages to plate electrodes 2 in the upper and/or lower arrays so as to form a DC potential well that extends in the x-dimension. The size of the ion trapping region in the x-dimension may extend over a relatively large distance so as to provide a relatively large ion trapping volume. The plates electrodes 2 may be curved to form an arcuate ion trapping region.

As shown on FIG. 2, ions enter the ion trapping region along the z-axis and over a fixed period of time and as a continuous stream of ions 4. The incident ion beam has a cross-section smaller than the dimensions of the ion trapping region. Without any active driving of ions within the ion trapping region, the volume occupied by ions during the ion trap filling is related to the rate of diffusion of the ions in the gas within the trapping region, the initial kinetic energy of the ions, the mobility of the ions and the driving force experienced by the ions due to space-charge interactions within the trapped ion cloud.

Figure 3:
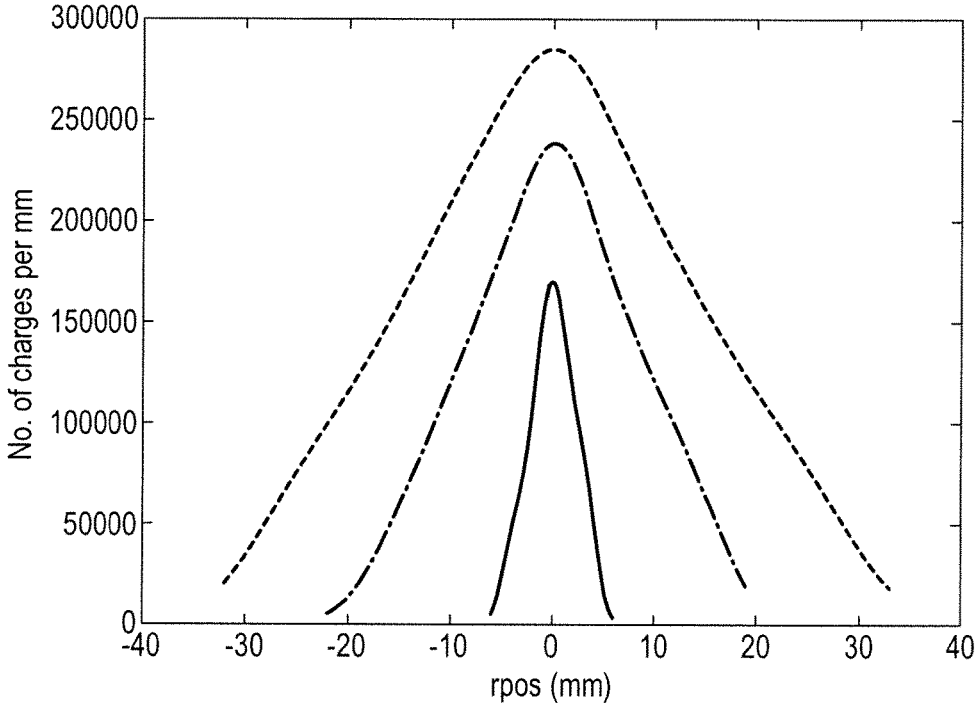
FIG. 3 shows a SIMION model of how an ion population is distributed within an extended trapping region during the trap fill cycle.

FIG. 3 shows a SIMION model of how an ion population is distributed within an extended trapping region during the trap fill cycle. The model is based on the arrangement shown in FIG. 2, wherein the plate electrodes 2 are considered to have a thickness of 0.5 mm, the spacing in the z-dimension between the plate electrodes 2 is considered to be 1 mm, and the ion confining region between the plate electrodes 2 in the y-dimension is considered to be 5 mm. The RF voltage applied to the plate electrodes 2 for confining ions in the y-dimension was modeled as having an amplitude of 125 V (0-peak) and a frequency of 2.5 MHz, with opposite phases applied to adjacent electrodes 2. Positive ion trapping was modeled. Ion trapping in the z-dimension was modeled by applying the same DC voltage to all of the plate electrodes 2 in the arrays, except for 8 consecutive plate electrodes 2 in the z-dimension, which were maintained at a DC voltage 20 V lower than the other plate electrodes 2. The dimension of the device in the x-dimension was modeled as not being restrained, so that the natural distribution of ions in this direction could be examined under differing conditions. The gas within the device was modeled as being nitrogen at 2.5 Torr. Ions having a mass to charge ratio of 500 were simulated as being created in the centre of the ion trapping region every 20 μs. The ions were simulated as carrying 20,000 charges, thus giving an average rate of 1000 charges per μs.

In FIG. 3, the Y-ordinate represents the number of charges per mm in the x-dimension and the X-ordinate represents the position along the x-axis in the ion trap (in mm), with 0 mm representing the central position along the x-axis of the ion trap. FIG. 3 shows three plots, representing the distribution of ions in the ion trap after ion filling durations of 1 ms (inner plot), 5 ms (middle plot) and 10 ms (outer plot). The plots in FIG. 3 show that ions fill more and more of the ion trapping volume as the ion accumulation time increases, due to increasing space-charge repulsion effects. However, it can also be seen that the maximum charge density, which occurs where the continuous ion beam enters the trapping region, continues to increase as the length of the trapping period increases. Therefore, under these conditions, this local region of the ion trapping volume fills at a faster rate than the space-charge repulsion drives ions out of this region to fill the ion trapping volume. The local charge density in this region therefore increases and ions may dissociate or become unstable due to interaction with the RF radial confining fields. For instance, in this example, at an ion fill time of 10 ms the ions have only become distributed over approximately 60 mm of the ion trapping volume (along the x-axis), regardless of how large the ion trapping volume is made in the x-dimension.

Figure 4:
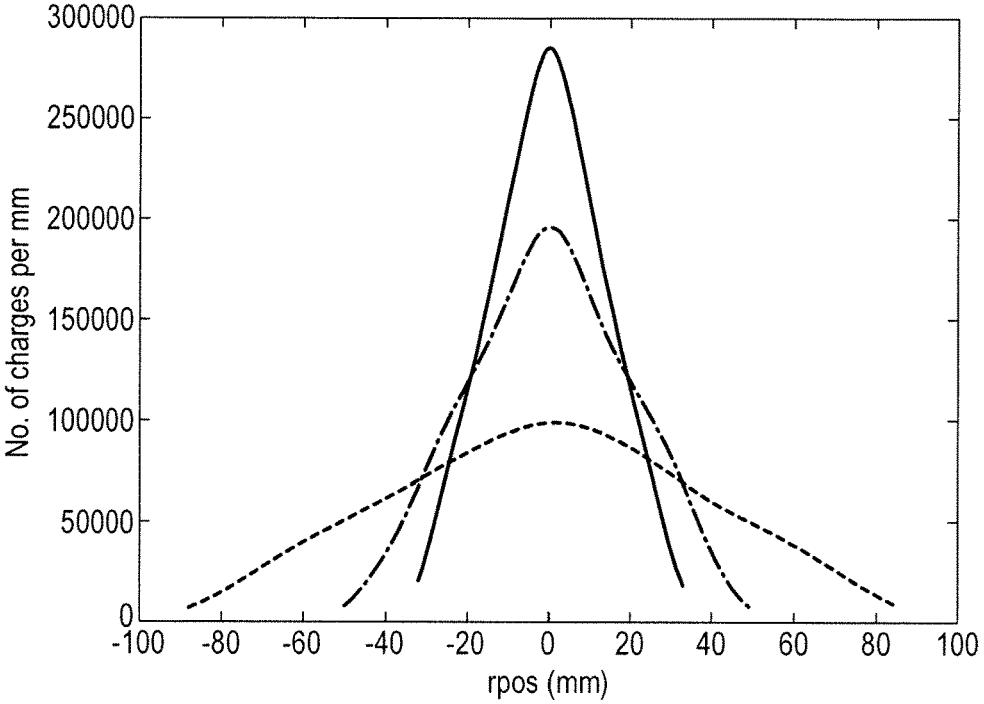
FIG. 4 shows similar plots to those shown in FIG. 3, except for various different ion trapping pressures.

FIG. 4 shows the same plot as in FIG. 3 for an ion filling duration of 10 ms and an ion trapping pressure of 2.5 Torr (uppermost plot). However, FIG. 4 also shows ion distributions after an ion filling duration of 10 ms for ion trapping pressures of 1 Torr (middle plot) and 0.2 Torr (lowermost plot). It can be seen from FIG. 4 that at 10 ms ions are distributed over a larger volume of the ion trap (in the x-dimension of the trap) when the trapping volume is maintained at a lower pressure. The peak charge density in the ion trapping region is therefore reduced at lower ion trapping pressures. Accordingly, when ion traps are operated at higher pressures, e.g. to couple them with drift time IMS devices, ions take longer to become distributed throughout the ion trapping volume and hence the peak charge density is relatively high.

Figure 5:
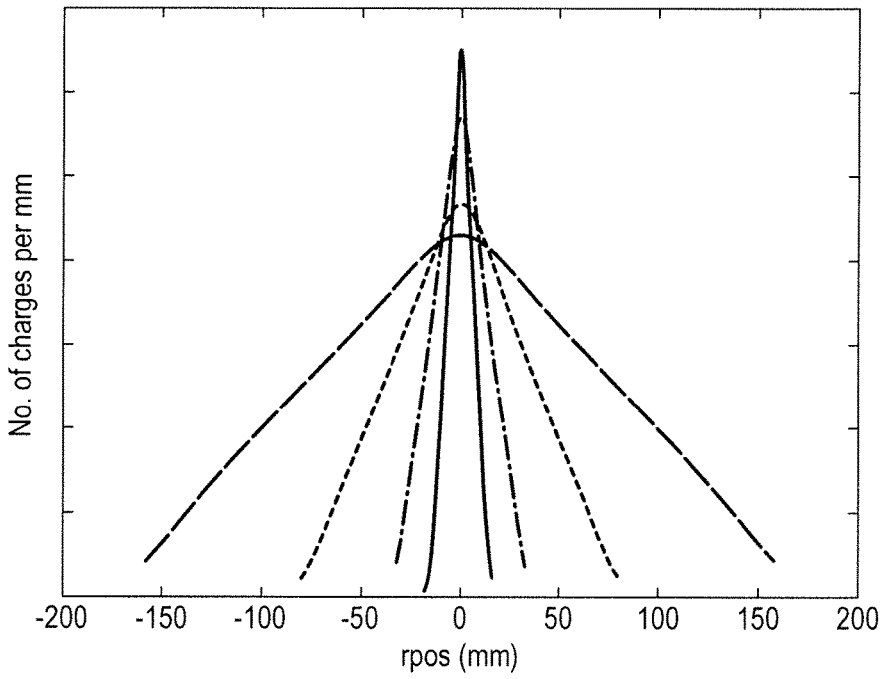
FIG. 5 shows similar plots to those shown in FIG. 3, except for four different ion fill rates.

FIG. 5 shows similar plots to those shown in FIG. 3, except for four different ion fill rates. FIG. 5 shows the ion distributions in the trap for the four ion fill rates at an ion filling duration of 10 ms and for an ion trapping pressure of 2.5 Torr of Nitrogen. The total number of charges introduced into the ion trapping region, the peak charge density at 10 ms and the spread of ions in the x-dimension of the ion trap after 10 ms are shown in the table below for the four different ion fill rates. The plots in FIG. 5 have been scaled in intensity so that the differences in the spreads of the ions in the X-direction of the ion trap can be seen more easily.

| Fill rate (charges/μs) | Total no. charges | Peak charge density ($mm^{-1}$) | Ion spread (mm) |
|---|---|---|---|
| 100 | $1 \times 10^6$ | $6.5 \times 10^4$ | 34 mm |
| 1000 | $1 \times 10^7$ | $2.85 \times 10^5$ | 68 mm |
| 10000 | $1 \times 10^8$ | $1.16 \times 10^6$ | 168 mm |
| 100000 | $1 \times 10^9$ | $5.37 \times 10^6$ | 320 mm |

The total number of charges introduced into the ion trapping region, the peak charge density and the spread of ions in the x-dimension of the ion trap increase with ion filling rate.

Figure 6:
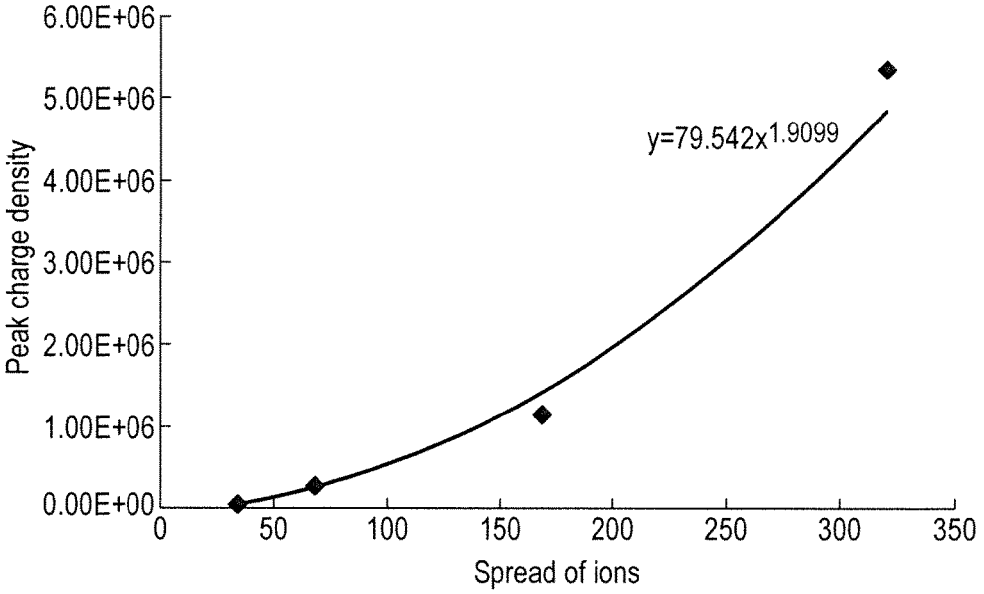
FIG. 6 shows the peak charge density in an ion trap as a function of the total spread of ions in a dimension of the ion trap.

FIG. 6 plots the peak charge density (charges/mm) in the ion trap of FIG. 5 as a function of the total spread of ions in the x-dimension of the ion trap (in mm). From this plot it is clear that as the input flux of ions increases the maximum charge density increases, and at a rate faster than the increasing space-charge effects can drive ions to fill the available trapping volume.

As described above, high charge densities may cause heating of the ions. In order to estimate the heating effect of the peak charge densities in the ion trap configuration of FIG. 2, SIMION was used to model this effect using uniform charge density distributions corresponding to peak charge densities. Trajectories were then modeled for ions in the fields derived from these distributions and average kinetic energies, and hence effective temperatures, were recorded. The effective temperatures were calculated according to the method described in TOLMACHEV ET AL, J Am Soc Mass Spectrom 2004, 15, 1616-1628.

Figure 7:
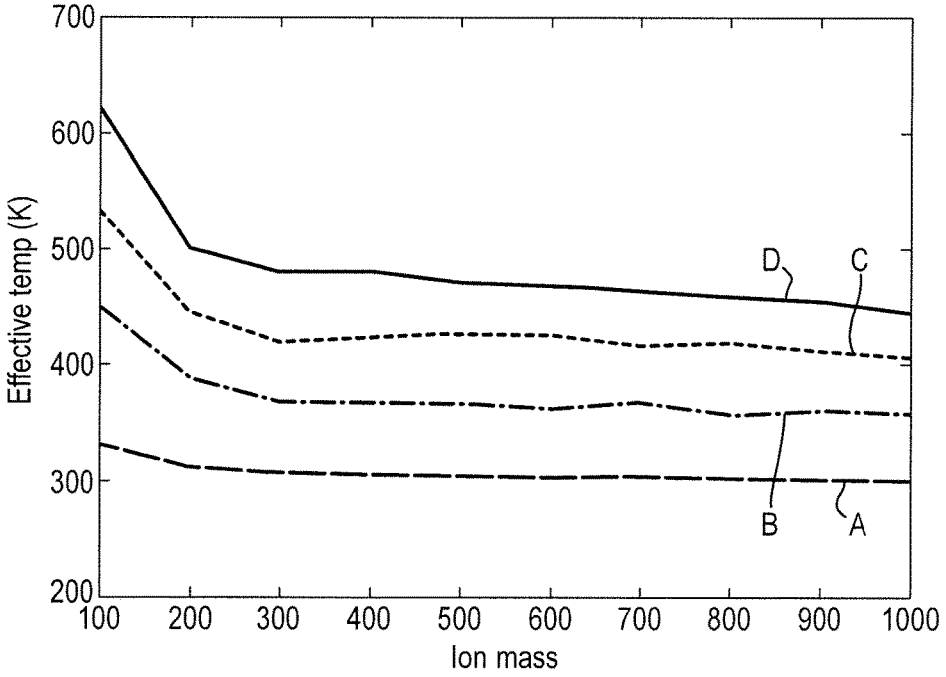
FIG. 7 shows plots of the effective temperatures as functions of mass to charge ratio for four different peak charge densities in the trap configuration of FIG. 2.

FIG. 7 shows plots of the effective temperatures as functions of mass to charge ratio for four different peak charge densities in the trap configuration of FIG. 2. The four charge peak charge densities are: $A=7.13\times10^4$ charges $mm^{-1}$, $B=2.85\times10^5$ charges $mm^{-1}$, $C=5.34\times10^5$ charges $mm^{-1}$, and $D=7.13\times10^5$ charges $mm^{-1}$. FIG. 7 shows that an increase in the peak charge density within the ion trap leads to a higher effective temperature, due to interaction between the ions and the RF confining field. This temperature increase can lead to ion losses due to dissociation of the ions.

It is also recognized that the peak charge density is related to the mobility of the ions. Low mobility ions will spread within the ion trap less than high mobility ions for the same ion fill rate and so the peak charge will be greater for low mobility ion species. Also, multiply charged ions of similar mass to charge ratio to ions of a lower charge state will spread within the trapping volume more rapidly and hence peak charge will be lower for the same fill rate. In practice, the incoming ion beam will be composed of ion species with a range of different mobilities, masses and charge states.

According to embodiments of the present invention, the local charge density within an ion trap is minimized by actively driving ions within the ion trapping region, or external to the ion trapping region, so that the ions become more evenly distributed within the ion trapping volume relatively quickly. This addressed adverse effects that would otherwise be cause by space-charge effects within the ion trap and within the IMS device.

Figure 8:
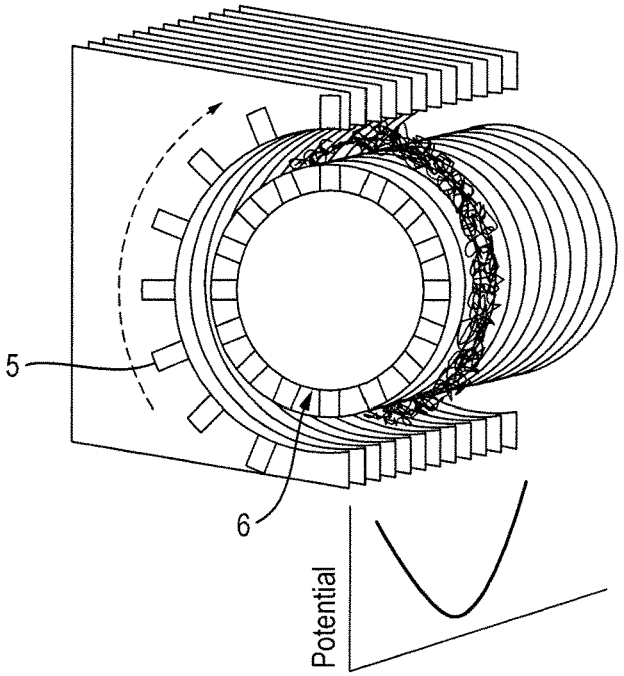
FIG. 8 shows an embodiment of the present invention having an annular ion confinement volume.

FIG. 8 shows an embodiment of the invention. The ion trap comprises an array of inner electrodes 6 and an array of outer electrodes 5 that define an annular ion confinement region therebetween. FIG. 8 only shows part of the array of outer electrodes 5, in order that the ion path can be seen more easily, although it will be appreciated that the outer array may extend fully around the circumference of the array of inner electrodes 6. RF voltages are applied to the arrays of electrodes 5,6 for confining ions in the annular space therebetween. More specifically, each array comprises a plurality of electrodes arranged along the longitudinal axis of the device and opposite phases of an RF voltage may be supplied to longitudinally adjacent electrodes in each array so as to radially confine the ions between the inner and outer arrays of electrodes. Different DC voltages are applied to the different electrodes along the axis of the device so as to define an axial DC trapping potential well that traps ions along the axis. In the illustrated embodiment, the axial trapping potential is a DC quadratic potential well. The device therefore defines an ion trapping volume for trapping the ions. Each of the inner array 6 and outer array 5 comprises a plurality of electrodes spaced circumferentially around the longitudinal axis for use as described further below.

In use, a beam of ions is directed into the ion trap along the longitudinal axis of the trap. Alternatively, the ions may enter the trap tangentially to the annular region, i.e. orthogonal to the longitudinal axis. A DC potential is successively applied to different ones of the electrodes that are spaced circumferentially around the longitudinal axis of the device, so as to drive the ions circumferentially around the annular region as they enter the ion trapping region. This driving force urges the ions away from the point of entry of the ion beam within the trapping region and distributes ions around the trapping volume.

Ions of high mobility will be driven with a higher velocity around the annular volume compared to ions with lower mobility. The annular design of the ion trap allows ions of high mobility to be driven circumferentially around the ion trapping volume multiple times, allowing ions of lower mobility to be distributed effectively and for the charge density at any local region to be minimized. This is in contrast to other ion trap configurations, such as that shown in FIG. 2, wherein the application of a driving force in the x-direction may concentrate ions of high mobility close to side plate electrodes 3 and hence may cause an increase in charge density.

Figure 9:
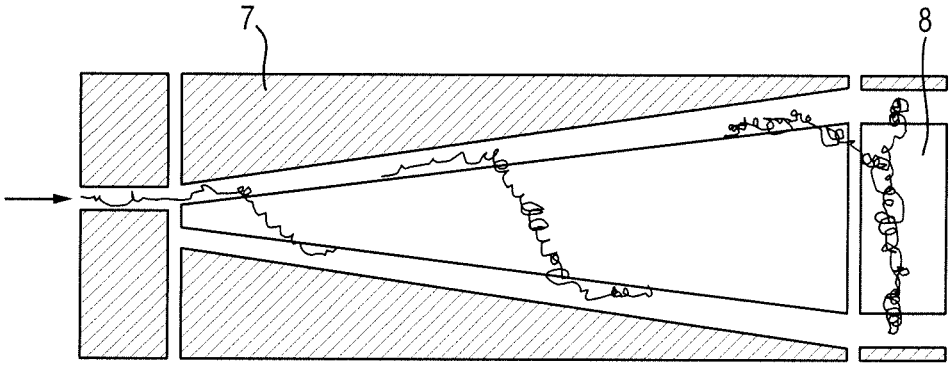
FIG. 9 shows another embodiment of the present invention having an annular inverted ion funnel around which ions spiral, and an annular ion trapping region.

FIG. 9 shows another embodiment of the present invention which may be used to efficiently fill an annular trapping volume. The device comprises a ion injection section, an annular inverted ion funnel 7 and an annular ion trapping region 8. The ion injection section forms an ion guide for guiding ions into the inverted ion funnel section 7. The inverted ion funnel section comprises an array of inner electrodes and an array of outer electrodes that define an annular ion confinement region therebetween, in a similar manner to the device of FIG. 8 except that the annular region has a progressively larger radius along the device in a direction from the entrance to the exit of the device. RF voltages are applied to the arrays of electrodes for confining ions in the annular space therebetween. Each array may comprise a plurality of electrodes arranged along the longitudinal axis of the device and opposite phases of an RF voltage may be supplied to longitudinally adjacent electrodes in each array so as to radially confine the ions between the inner and outer arrays of electrodes. Different DC voltages may be applied to different electrodes along the axis of the device so as to define an axial DC potential that urges ions along the axis to the ion trapping region 8. Each of the inner array and outer array of electrodes may comprise a plurality of electrodes spaced circumferentially around the longitudinal axis for use as described further below.

In use, a beam of ions is directed into the ion trap along the longitudinal axis of the trap. Alternatively, the ions may enter the trap tangentially to the annular region, i.e. orthogonal to the longitudinal axis. The ions then pass into the inverted ion funnel section 7. A DC potential is successively applied to different ones of the electrodes that are spaced circumferentially around the longitudinal axis of the inverted ion funnel section 7, so as to drive the ions circumferentially around the annular region as they enter the inverted ion funnel section 7. This driving force urges the ions away from the point of entry of the ion beam within the inverted ion funnel section 7 and circulates the ions around the annular region. The ions then pass into the annular ion trapping region 8, which comprises an array of inner electrodes and an array of outer electrodes that define an annular ion confinement region therebetween. RF voltages are applied to the arrays of electrodes for radially confining ions in the annular space therebetween. Each array may comprise a plurality of electrodes arranged along the longitudinal axis of the device and opposite phases of an RF voltage may be supplied to longitudinally adjacent electrodes in each array so as to radially confine the ions between the inner and outer arrays of electrodes. Different DC voltages may be applied to different electrodes along the axis of the device so as to define an axial DC potential for axially trapping ions along the axis of the ion trapping region 8. Once the ions enter the annular ion trapping region 8 from the inverted ion funnel 7, the ions continue to rotate around the longitudinal axis of the device, thereby distributing the charge density within the ion trapping region 8 in a similar manner to the embodiment in FIG. 8.

Figure 10:
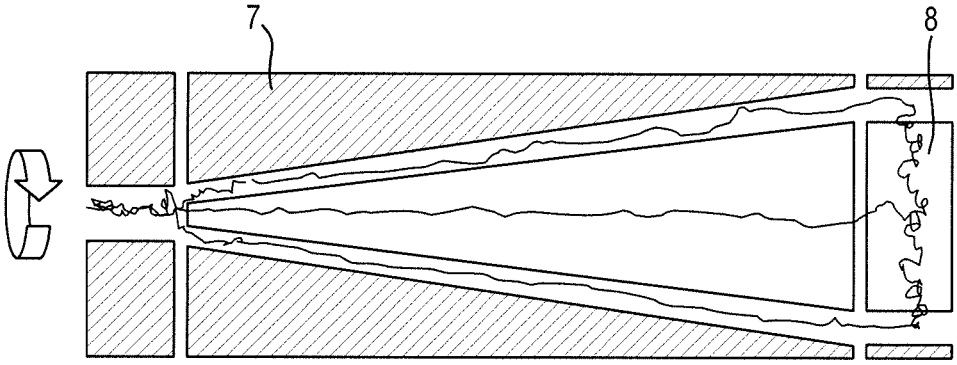
FIG. 10 shows another embodiment of the present invention that is structurally similar to that shown in FIG. 9, except that the ions are not spiralled around the ion funnel.

FIG. 10 shows another embodiment of the present invention that is structurally similar to that shown in FIG. 9, except that the inner and outer arrays of electrodes need not (although may) comprise electrodes spaced circumferentially around the longitudinal axis for use in rotating the ions around the longitudinal axis. Rather, in the embodiment of FIG. 10, the continuous ion beam is deflected in a circular motion by a segmented deflection electrode as the continuous beam enters the inverted funnel region. More specifically, the ion beam travels substantially parallel to the longitudinal axis of the device prior to entering the device. Deflection electrodes then deflect the ions away from this axis as, or prior to, the ions entering the device. The ions are deflected in a direction orthogonal to the axis, but maintain a component of velocity along the axis such that the ions continue into the inverted ion funnel section. Although the ions are always deflected orthogonal to the axis, the orthogonal direction in which the ions are deflected varies with time such that ions entering the device at different times travel along different paths through the inverted funnel section and arrive at different regions of the annular trapping region. The orthogonal direction in which the ions are deflected may rotate around the longitudinal axis with time, either continuously or in a stepped manner. The orthogonal direction in which the ions are deflected may rotate around the longitudinal axis at least once during the fill time of the ion trap. The orthogonal deflection may be achieved by providing deflection electrodes around the axis and energising these electrodes at different times such that the orthogonal direction in which the ions are deflected varies with time. The embodiment of FIG. 10 is able to distribute ions around the annular trapping volume in a manner that is largely independent of the mobility of the ions.

Figure 11:
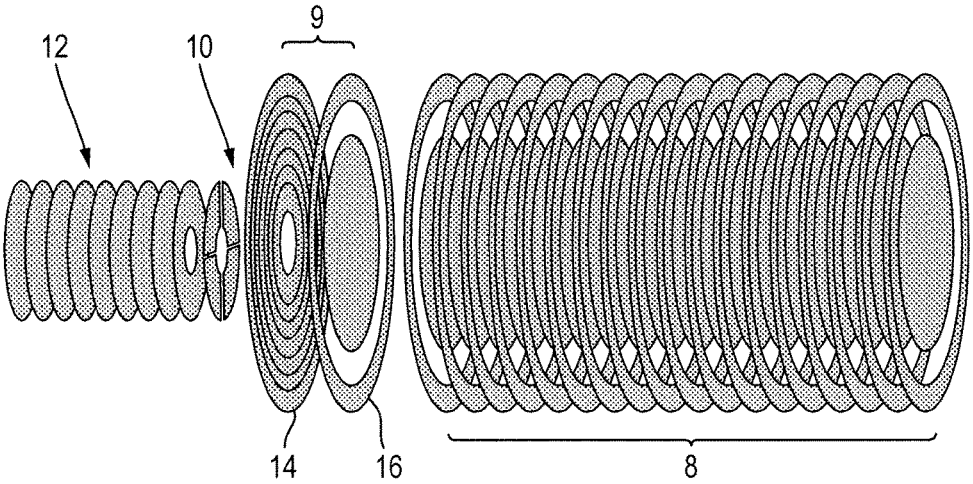
FIG. 11 shows another embodiment of the present invention comprising an orthogonal ion distribution region and an annular ion trapping region.

FIG. 11 shows another embodiment of the present invention. This embodiment comprises the sequential arrangement of an ion tunnel ion guide 12, an orthogonal ion distribution region 9 and an annular ion trapping region 8. An ion deflector 10 may be provided between the ion tunnel ion guide and the orthogonal ion distribution region 9. The ion tunnel ion guide comprises a plurality of apertured electrodes. The orthogonal ion distribution region 9 may comprise a first member 14 having a aperture therein and arranged at the longitudinal axis for allowing ions to pass therethrough. The first member of the orthogonal ion distribution region 9 also comprises a plurality of electrodes arranged concentrically around the aperture at different radial distances from the aperture. The orthogonal ion distribution region 9 comprises a second member 16 downstream of the first member. The second member comprises an inner electrode and an outer electrode that define an annular aperture therebetween for allowing ions to pass therethrough. The ion trapping region is arranged downstream of the orthogonal ion distribution region 9. The ion trapping region comprises an array of inner electrodes and an array of outer electrodes that define an annular ion confinement region therebetween.

In use, RF voltages are applied to the electrodes of the ion tunnel ion guide 12 so as to radially confine ions within the ion guide along the longitudinal axis of the device. Opposite phases of an RF voltage may be applied to longitudinally adjacent electrodes in the ion guide so as to radially confine the ions. The ions travel axially along the ion guide and through the aperture in the first member of the orthogonal ion distribution region 9. The ions pass into the region axially between the first and second members of the orthogonal ion distribution region 9. RF voltages are applied to the concentric electrodes of the first member 14 and an RF or DC voltage is applied to at least the central electrode of the second member 16 so that ions are repelled away from these members and hence confined axially between the first and second members. The central electrode of the second member 16 therefore acts as an ion blocking electrode that repels ions away from it. Different DC voltages are applied to the concentric electrodes on the first member of the orthogonal ion distribution region 9 so as to create a DC gradient that drives the ions radially outward and towards the annular aperture in the second member 16 of the orthogonal ion distribution region 9. Alternatively, a DC potential may be successively applied to successive concentric electrodes on the first member such that the ions are driven radially outward towards the annular aperture in the second member of the orthogonal ion distribution region 9. The DC potential may be repeatedly travelled along the concentric electrodes in this manner. The orthogonal ion distribution region 9 may therefore be operated to distribute ions evenly around an annulus within the device.

Electric potentials are applied to the first member 14 and/or second member 16 and/or ion trapping region 8 so as to urge the ions through the annular aperture in the second member of the orthogonal ion distribution region 9 and into the ion trapping region 8. RF voltages are applied to the arrays of electrodes in the ion trapping region 8 for confining ions in the annular space therebetween. More specifically, each array may comprises a plurality of electrodes arranged along the longitudinal axis of the device and opposite phases of an RF voltage may be supplied to longitudinally adjacent electrodes in each array so as to radially confine the ions between the inner and outer arrays of electrodes. Different DC voltages are applied to the different electrodes along the axis of the device so as to define an axial DC trapping potential well that traps ions along the axis. The axial trapping potential may be a DC quadratic potential well. The orthogonal ion distribution region 9 therefore enables the ion trapping region 8 to be filled with ions such that the ions are distributed substantially evenly around an annulus within the ion trapping region.

As mentioned above, an ion deflector 10 may be provided between the ion tunnel ion guide 12 and the orthogonal ion distribution region 9. Embodiments of the ion deflector are shown in FIGS. 12A and 12B.

Figure 12A:
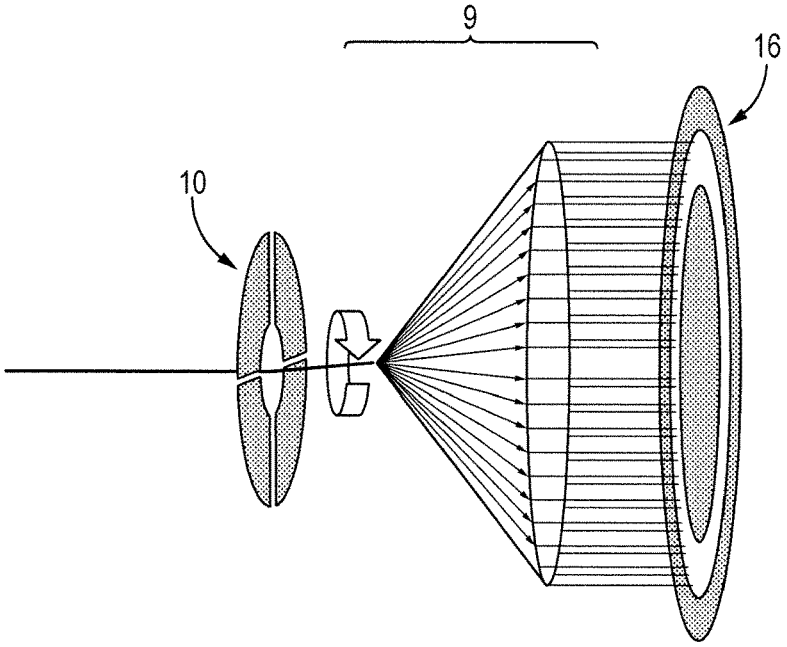
FIGS. 12A and 12B show schematics of an ion deflector being operated in different modes.

FIG. 12A shows a schematic representation of the DC potential surface and ion trajectories within the orthogonal ion distribution region 9. This demonstrates that the orthogonal ion distribution region 9 drives the ions radially outwards and through the annular aperture in the second member 16 of the orthogonal ion distribution region 9. FIG. 12A also shows the ion deflector 10 that may be provided between the ion tunnel ion guide and the orthogonal ion distribution region 9. The ion deflector 10 may be a segmented deflection electrode for deflecting the ion beam in a circular motion as the beam enters the orthogonal ion distribution region 9. More specifically, the ion beam travels substantially parallel to the longitudinal axis of the device prior to entering the ion deflector. Electrodes of the ion deflector 10 then deflect the ions away from this axis. The ions are deflected in a direction orthogonal to the axis, but maintain a component of velocity along the axis such that the ions continue into the orthogonal ion distribution region 9. Although the ions are always deflected orthogonal to the axis, the orthogonal direction in which the ions are deflected varies with time such that ions entering the ion deflector at different times travel along different paths through the orthogonal ion distribution region 9 and arrive at different regions of the annular trapping region. The orthogonal direction in which the ions are deflected may rotate around the longitudinal axis with time, either continuously or in a stepped manner. The orthogonal direction in which the ions are deflected may rotate around the longitudinal axis at least once during the fill time of the ion trap. The orthogonal deflection may be achieved by providing deflection electrodes around the axis and energising these electrodes at different times such that the orthogonal direction in which the ions are deflected varies with time.

Figure 12B:
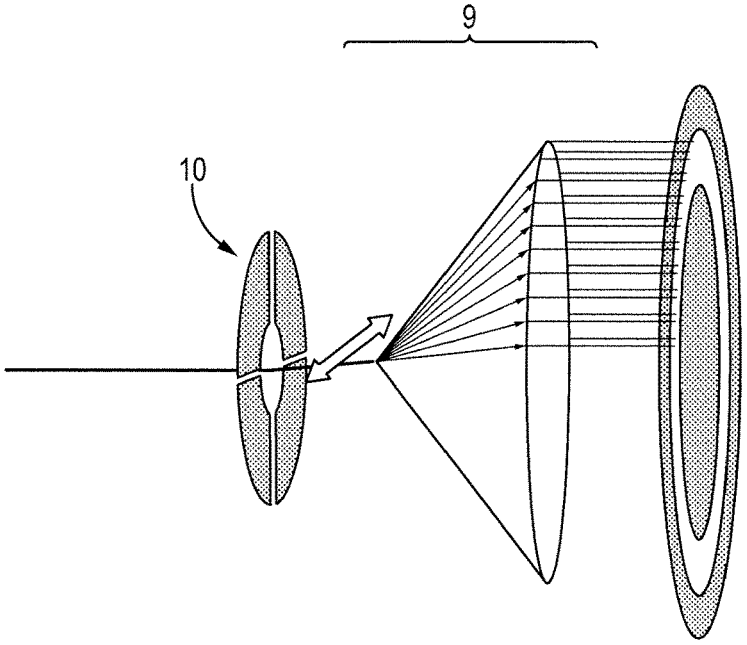

FIG. 12B shows a mode in which the ion deflector 10 is operated so as to distribute ions over only part of the trapping region. In this mode the voltages applied to the electrodes of the ion deflector are varied with time such that ions are only deflected along a single axis orthogonal to the longitudinal axis. For example, voltages may be applied to the ion deflector so as to scan ions in a single dimension orthogonal to the longitudinal axis. These ions then enter the orthogonal ion distribution region 9 and are forced radially outward, thereby filling a semi-circular region of the annular ion trapping region.

Although various annular ion trapping regions have been described, the present invention is not limited to annular trapping regions. For example, an ion deflector of the type described in relation to FIGS. 10 and 12 may be employed with non-annular ion trapping regions in order to reduce the peak charge density within the ion trap.

Figure 13:
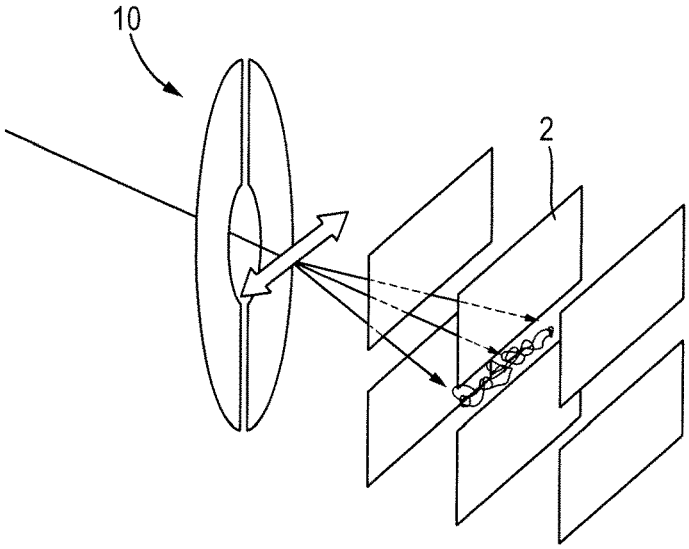
FIG. 13 shows a schematic of an ion deflector being operated in yet another mode.

FIG. 13 shows a schematic of an embodiment of the present invention in which an ion deflector 10 is used to fill an ion trap of the type described in relation to FIG. 2. The ion deflector is used to deflect ions that are travelling into the ion trap to different positions along the X-axis of the ion trap. This may be achieved by varying the voltages applied to the electrodes of the ion deflector with time so that the ions are scanned along the X-axis of the trap. By dynamically deflecting the incoming ion beam during filling of the ion trap, the increase in local space charge observed during filling of the trap may be dramatically reduced, thereby allowing a much larger volume of the ion trap to be utilized and a higher total space-charge capacity to be realized.

Figure 14A:
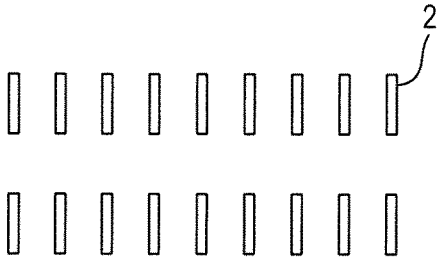
FIGS. 14A-14C show other embodiments of the invention, wherein ions are driven along the longitudinal axis of an elongated ion trapping region.
Figure 14B:
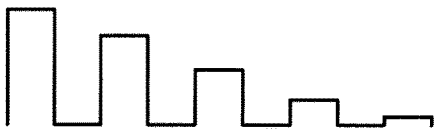
Figure 14C:
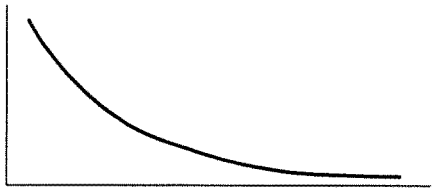

FIG. 14A shows another embodiment of the invention corresponding to the arrangement shown in FIG. 2, except wherein the ion trap is extended in a direction parallel to the incoming ion beam axis, and wherein ions are driven in a direction parallel to the ion beam so as to be distributed more evenly along the ion trap. As described previously, driving ions along the ion trap towards the side or end of an ion trap would result in ions concentrating at one side or end of the trapping region, leading to increased local charge density at that region, particular for ions of high mobility. However, in the embodiment of FIG. 14A, this is somewhat mitigated by driving the ions from the entrance of the ion trap towards the exit of the ion trap using a travelling DC potential or wave that decays in amplitude as it travels from the entrance to the exit of the trap (shown in FIG. 14B). Alternatively, ions may be driven from the entrance of the ion trap towards the exit of the ion trap using a non-linear DC potential gradient that decays in amplitude in a direction from the entrance to the exit of the trap (shown in FIG. 14C), resulting in a reduction in the driving force at the exit of the trapping region as compared to the entrance of the ion trapping region. However, even using these modified fields, it is difficult to distribute ions of different mobility evenly within the trapping volume.

Although the present invention has been described with reference to various embodiments, it will be understood by those skilled in the art that various changes in form and detail may be made without departing from the scope of the invention as set forth in the accompanying claims.

For example, the deflection electrode can be used to control the filling time of the ion trap to control the total space charge in the trap. In this case the electrode directs the beam to a point outside the trapping region for a period within the fill time.

The invention claimed is:

1. An ion trapping system comprising:

a plurality of electrodes;

one or more voltage supplies connected to the electrodes, wherein the electrodes and the one or more voltage supplies are adapted and configured to provide an ion trap;

an ion entrance for receiving ions into the ion trap along an ion entrance axis, in use;

an ion ejecting system for ejecting ions from the ion trap along an ion exit axis in use, wherein the electrodes and voltage supplies are configured such that the maximum dimension over which the ion trap extends orthogonal to the entrance axis is greater than the maximum dimension over which the ion trap extends parallel to the entrance axis; and further comprising one or more of the following:

an ion deflector arranged upstream of the ion trap, wherein the ion deflector is configured to deflect at least some of the ions travelling towards the ion trap such that ions entering the ion trap enter an ion trapping region at different locations; and/or an ion deflector arranged upstream of, or at the entrance to, the ion trap, wherein the ion deflector is configured to deflect at least some of the ions travelling towards or into the ion trap such that ions enter the ion trap with different speeds orthogonal to the entrance axis so that the ions spread out within the ion trap in a direction orthogonal to the entrance axis.

2. The system of any of claim 1, wherein the ion deflector is configured to deflect ions travelling towards the ion trap such that ions entering the ion trap either (i) at the same time, or (ii) at different times, enter the ion trap at different locations.

3. The system of any of claim 1, wherein the ion deflector comprises at least one electrode and at least one voltage supply adapted and configured to apply a time varying electrical potential to the at least one electrode for performing the step of deflecting the ions.

4. The system of any of claim 1, wherein the ion deflector comprises an inverted ion funnel arranged upstream of the ion trap, the inverted ion funnel comprising at least one inner electrode and at least one outer electrode surrounding the at least one inner electrode and defining an ion guiding path therebetween, wherein the ion guiding path has a cross-sectional area that increases in a direction towards the ion trap.

5. The system of claim 4, wherein the ion deflector is configured to cause ions to spiral around the at least one inner electrode as they travel towards the ion trap; or wherein the ion deflector is configured to cause ions to travel in an axial direction along the ion funnel, substantially without spiralling around the at least one inner electrode, and such that the ions entering the inverted ion funnel at different times travel along different axial ion paths.

6. The system of claim 1, wherein the ion deflector comprises at least one electrode arranged radially spaced from an ion beam axis and at least one voltage supply configured to apply at least one voltage to this at least one electrode so as to simultaneously urge ions in multiple directions orthogonal to the ion beam axis.

7. The system of claim 6, wherein the at least one electrode comprises a plurality of electrodes arranged at different radial distances from the ion beam axis, and wherein the at least one voltage supply is configured to apply DC potentials to these electrodes so as to generate a static DC potential gradient in the radially outward direction or a travelling DC potential barrier that travels in the radially outward direction for simultaneously urging ions in multiple directions orthogonal to the ion beam axis.

8. The system of claim 6, wherein the ion deflector comprises an ion blocking electrode arranged downstream of said at least one electrode on the ion beam axis and a voltage supply for applying a voltage to the ion blocking electrode to repel ions away from it.

9. The system of claim 1, comprising a controller and electronic circuitry arranged and configured to:

control the one or more voltage supplies so as to apply voltages to the electrodes such that ions are able to be received into the ion trap along said entrance axis and trapped in the ion trap during an ion filling period; and wherein the controller is arranged and configured to:

(i) control the ion deflector to deflect at least some of the ions travelling towards the ion trap such that ions entering the ion trap enter the ion trapping region at different locations during the ion filling period; and/or (ii) control the ion deflector to deflect at least some of the ions travelling towards or into the ion trap such that ions enter the ion trap with different speeds orthogonal to the entrance axis during the ion filling period so that the ions spread out within the ion trap in a direction orthogonal to the entrance axis.

10. A method of trapping ions comprising:

providing an ion trapping system as claimed in claim 1;

applying voltages to the plurality of electrodes;

receiving ions into the ion trap along the ion entrance axis and preventing ions exiting the ion trap, whilst performing one or more of the following:

(i) using the ion deflector to deflect ions travelling towards the ion trap such that ions entering the ion trap enter the ion trapping region at different locations; and/or (ii) using the ion deflector to deflect ions travelling towards or into the ion trap such that ions enter the ion trap with different speeds orthogonal to the entrance axis so that the ions spread out within the ion trap in a direction orthogonal to the entrance axis.

* * * * *